US009033210B2

(12) United States Patent
Kastanek

(10) Patent No.: US 9,033,210 B2
(45) Date of Patent: May 19, 2015

(54) CARTON WITH HANDLE

(71) Applicant: Graphic Packaging International, Inc., Marietta, GA (US)

(72) Inventor: Raymond S. Kastanek, Kennesaw, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 184 days.

(21) Appl. No.: 13/653,536

(22) Filed: Oct. 17, 2012

(65) Prior Publication Data

US 2013/0092725 A1 Apr. 18, 2013

Related U.S. Application Data

(60) Provisional application No. 61/627,732, filed on Oct. 17, 2011, provisional application No. 61/630,188, filed on Dec. 6, 2011.

(51) Int. Cl.

| | |
|---|---|
| ***B65D 5/42*** | (2006.01) |
| ***B65D 71/36*** | (2006.01) |
| *B65D 5/468* | (2006.01) |

(52) U.S. Cl.

CPC ..... *B65D 71/36* (2013.01); *B65D 5/4608* (2013.01); *B65D 5/4208* (2013.01); *B65D 2571/00141* (2013.01); *B65D 2571/00265* (2013.01); *B65D 2571/0045* (2013.01); *B65D 2571/00524* (2013.01); *B65D 2571/00654* (2013.01); *B65D 2571/00728* (2013.01)

(58) Field of Classification Search

CPC ..... B65D 5/4208; B65D 5/4608

USPC ..... 229/117.16, 117.17; 206/427

See application file for complete search history.

(56) References Cited

U.S. PATENT DOCUMENTS

| | | | | |
|---|---|---|---|---|
| 2,196,502 | A | 4/1940 | Kells | |
| 2,308,050 | A | 1/1943 | Burr | |
| 2,386,905 | A | 10/1945 | Meitzen | |
| 2,645,405 | A * | 7/1953 | Dorfman | 229/117.16 |
| 2,648,484 | A | 8/1953 | Belsinger | |
| 2,702,155 | A * | 2/1955 | Baumann | 229/117.17 |
| 2,900,123 | A | 8/1959 | Drnec et al. | |
| 2,955,739 | A | 10/1960 | Collura | |
| 3,094,268 | A | 6/1963 | Swanson et al. | |
| 3,112,856 | A | 12/1963 | MacIntosh et al. | |
| 3,173,596 | A | 3/1965 | Aust et al. | |
| 3,756,499 | A | 9/1973 | Giebel et al. | |

(Continued)

FOREIGN PATENT DOCUMENTS

| | | |
|---|---|---|
| EP | 0870688 A1 | 10/1998 |
| WO | WO 99/28198 | 6/1999 |
| WO | WO 2008/027954 A1 | 3/2008 |

OTHER PUBLICATIONS

International Search Report and Written Opinion for PCT/US2012/060530 dated Mar. 21, 2013.

*Primary Examiner* — Gary Elkins

(74) *Attorney, Agent, or Firm* — Womble Carlyle Sandridge & Rice, LLP

(57) ABSTRACT

A carton for containing a plurality of articles. The carton comprises panels that extend at least partially around an interior of the carton. The panels comprise a top panel, a bottom panel, a first side panel, and a second side panel. The carton has a reinforced handle for grasping and carrying the carton.

39 Claims, 16 Drawing Sheets

(56) References Cited

U.S. PATENT DOCUMENTS

| | | | | |
|---|---|---|---|---|
| 4,005,815 | A | 2/1977 | Nerenberg et al. | |
| 4,165,031 | A * | 8/1979 | Osborne | 229/117.16 |
| 4,318,474 | A | 3/1982 | Hasegawa | |
| 4,498,619 | A | 2/1985 | Roccaforte | |
| 4,538,759 | A | 9/1985 | Dutcher | |
| 4,621,766 | A | 11/1986 | McClure | |
| 4,679,726 | A | 7/1987 | Oliff | |
| 4,784,316 | A | 11/1988 | Crouch | |
| 4,966,324 | A | 10/1990 | Steel | |
| 5,072,876 | A | 12/1991 | Wilson | |
| 5,119,985 | A | 6/1992 | Dawson et al. | |
| 5,197,598 | A | 3/1993 | Stout et al. | |
| 5,350,109 | A | 9/1994 | Brown et al. | |
| 5,472,136 | A | 12/1995 | Roccaforte | |
| 5,588,585 | A | 12/1996 | McClure | |
| 5,794,778 | A | 8/1998 | Harris | |
| 6,065,590 | A | 5/2000 | Spivey | |
| 6,112,977 | A | 9/2000 | Sutherland et al. | |
| 6,131,803 | A | 10/2000 | Oliff et al. | |
| 6,170,741 | B1 | 1/2001 | Skolik et al. | |
| 6,250,542 | B1 | 6/2001 | Negelen | |
| 6,273,330 | B1 | 8/2001 | Oliff et al. | |
| 6,595,411 | B2 | 7/2003 | McClure | |
| 6,631,803 | B2 | 10/2003 | Rhodes et al. | |
| 6,766,940 | B2 | 7/2004 | Negelen | |
| 6,848,573 | B2 | 2/2005 | Gould et al. | |
| 6,968,992 | B2 | 11/2005 | Schuster | |
| 7,614,497 | B2 | 11/2009 | Spivey, Sr. | |
| 7,703,666 | B2 | 4/2010 | Hand et al. | |
| 7,743,970 | B2 * | 6/2010 | Bates et al. | 229/117.16 |
| 7,748,603 | B2 | 7/2010 | Fogle et al. | |
| 7,757,933 | B2 | 7/2010 | Dunn | |
| 7,775,418 | B2 | 8/2010 | Walling | |
| 7,780,003 | B2 | 8/2010 | Harrelson | |
| 7,780,067 | B2 | 8/2010 | Holley, Jr. | |
| 7,806,314 | B2 | 10/2010 | Sutherland | |
| 7,815,097 | B2 | 10/2010 | Fogle et al. | |
| 7,832,622 | B2 | 11/2010 | Spivey, Sr. | |
| 7,900,816 | B2 | 3/2011 | Kastanek et al. | |
| 7,984,843 | B2 | 7/2011 | Cooper et al. | |
| 7,998,047 | B2 | 8/2011 | Spivey, Sr. et al. | |
| 8,070,052 | B2 | 12/2011 | Spivey, Sr. et al. | |
| 8,191,761 | B2 | 6/2012 | Brand | |
| 8,216,118 | B2 | 7/2012 | Dunn | |
| 8,302,811 | B2 | 11/2012 | Spivey | |
| 8,602,292 | B2 * | 12/2013 | Brand | 229/117.16 |
| 2005/0087592 | A1 | 4/2005 | Schuster | |
| 2005/0189405 | A1 | 9/2005 | Gomes et al. | |
| 2005/0263574 | A1 | 12/2005 | Schuster | |
| 2006/0081691 | A1 | 4/2006 | Smalley | |
| 2006/0169755 | A1 | 8/2006 | Spivey, Sr. | |
| 2006/0278689 | A1 | 12/2006 | Boshinski et al. | |
| 2007/0063003 | A1 | 3/2007 | Spivey et al. | |
| 2007/0108261 | A1 | 5/2007 | Schuster | |
| 2007/0131748 | A1 | 6/2007 | Brand | |
| 2008/0110967 | A1 | 5/2008 | Walling | |
| 2008/0203143 | A1 * | 8/2008 | Holley | 229/117.16 |
| 2010/0025457 | A1 | 2/2010 | Cooper et al. | |
| 2011/0240725 | A1 * | 10/2011 | Spivey et al. | 229/117.16 |
| 2011/0284624 | A1 | 11/2011 | DeBusk et al. | |
| 2012/0012600 | A1 | 1/2012 | Gonzalez | |
| 2012/0067755 | A1 * | 3/2012 | Spivey, Sr. | 206/427 |

* cited by examiner

CARTON WITH HANDLE

CROSS-REFERENCE TO RELATED APPLICATIONS

This application claims the benefit of U.S. Provisional Application No. 61/627,732, which was filed on Oct. 17, 2011. This application also claims the benefit of U.S. Provisional Application No. 61/630,188, which was filed on Dec. 6, 2011.

INCORPORATION BY REFERENCE

U.S. Provisional Patent Application No. 61/518,504, filed May 6, 2011, U.S. Provisional Application No. 61/572,638, filed Jul. 19, 2011, U.S. Provisional Patent Application No. 61/627,249, filed Oct. 7, 2011, U.S. Provisional Patent Application No. 61/627,732, filed Oct. 17, 2011, U.S. Provisional Application No. 61/630,188, filed Dec. 6, 2011, and U.S. Non-Provisional application Ser. No. 13/419,740, filed Mar. 14, 2012 are hereby incorporated by reference for all purposes as if presented herein in their entirety.

BACKGROUND OF THE DISCLOSURE

The present disclosure generally relates to cartons for holding beverage containers or other types of articles. More specifically, the present disclosure relates to cartons having a reinforced handle and other features.

SUMMARY OF THE DISCLOSURE

In general, one aspect of the disclosure is directed to a carton for containing a plurality of articles. The carton comprises a plurality of panels that extends at least partially around an interior of the carton, the plurality of panels comprises a top panel, a bottom panel, a first side panel, and a second side panel. The carton further comprises at least three first end flaps respectively foldably attached to respective panels of the plurality of panels. The at least three first end flaps cooperate to close a first end of the carton and the at least three first end flaps comprise a first side end flap foldably connected to the first side panel, a second side end flap foldably connected to the second side panel, and a top end flap foldably connected to the top panel. The carton further comprises a handle in the first end of the carton for grasping and carrying the carton. According to this aspect of the disclosure the first side end flap comprises a first main panel, a first handle feature for forming the handle, a first reinforcement portion above the first handle feature, and a reinforcement flap foldably connected to the first reinforcement portion. Furthermore, the second side end flap comprises a second main panel, a second handle feature for forming the handle, and a second reinforcement portion above the second handle feature. Additionally, the reinforcement flap is downwardly folded to at least partially overlap the second reinforcement portion to reinforce the handle.

In another aspect, the present disclosure is generally directed to a blank for forming a carton having a reinforced handle. The blank comprises a plurality of panels comprising a top panel, a bottom panel, a first side panel, and a second side panel. The blank further comprises at least three first end flaps respectively foldably connected to respective panels of the plurality of panels. The at least three first end flaps are configured to cooperate to close a first end of a carton formed of the blank, and the at least three first end flaps comprise a first side end flap foldably connected to the first side panel, a second side end flap foldably connected to the second side panel, and a top end flap foldably connected to the top panel. The blank further comprises features for forming a handle in the at least three first end flaps. The first side end flap comprises a first main panel, a first handle feature for forming the handle, a first reinforcement portion above the first handle feature, and a reinforcement flap foldably connected to the first reinforcement portion. Furthermore, the second side end flap comprises a second main panel, a second handle feature for forming the handle, and a second reinforcement portion above the second handle feature. Additionally, the reinforcement flap is configured to be downwardly folded to at least partially overlap the second reinforcement portion to reinforce the handle.

In another aspect, the present disclosure is generally directed to a method of forming a carton having a reinforced handle. The method comprises obtaining a blank comprising a plurality of panels. The plurality of panels comprises a top panel, a bottom panel, a first side panel, and a second side panel. The blank further comprises at least three first end flaps respectively foldably connected to respective panels of the plurality of panels. The at least three first end flaps comprise a first side end flap foldably connected to the first side panel, a second side end flap foldably connected to the second side panel, and a top end flap foldably connected to the top panel. The first side end flap comprises a first main panel, a first handle feature, a first reinforcement portion above the first handle feature, and a reinforcement flap foldably connected to the first reinforcement portion. The second side end flap comprises a second main panel, a second handle feature, and a second reinforcement portion above the second handle feature. The method further comprises forming at least a portion of an interior of the carton by folding the plurality of panels, folding the at least three first end flaps to at least partially close a first end of the carton, at least partially forming the handle from the first handle feature and the second handle feature, and downwardly folding the reinforcement flap to at least partially overlap the second reinforcement portion to reinforce the handle.

Other aspects, features, and details of the present disclosure can be more completely understood by reference to the following detailed description of exemplary embodiments taken in conjunction with the drawings and from the appended claims.

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to cartons that contain articles such as containers, bottles, cans, etc., and handle reinforcement features of such cartons. The articles can be used for containing food and beverage products, for example. The articles can be made from materials suitable in composition for packaging the particular food or beverage item, and the materials can include, but are not limited to, glass or other breakable material; aluminum and/or other metals; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., glass beverage bottles) as disposed within the carton embodiments. In this specification, the terms "lower," "bottom," "upper" and "top" indicate orientations determined in relation to fully erected and upright cartons.

Figure 1:
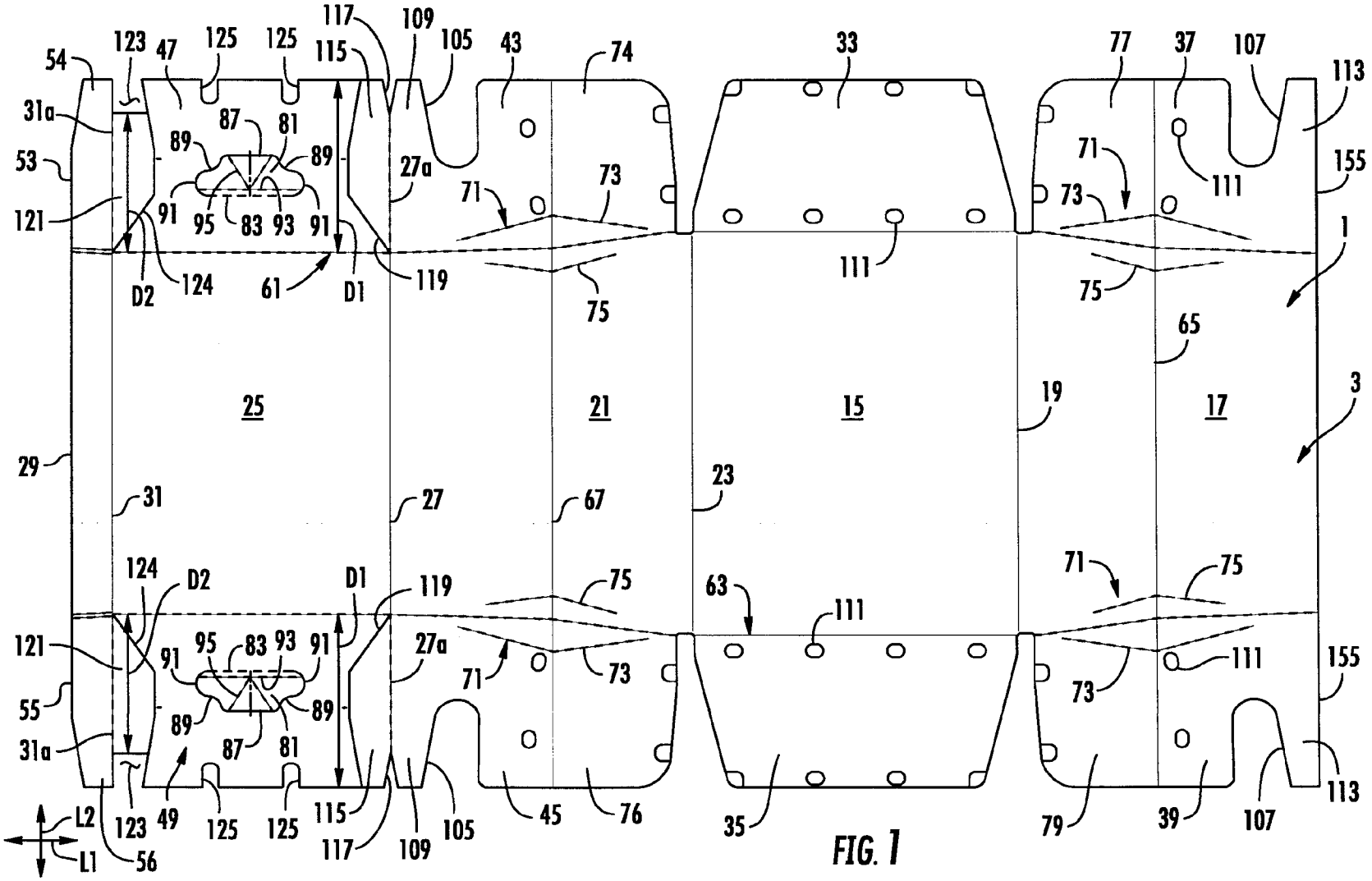
FIG. 1 is a plan view of a blank of a carton, according to a first embodiment.
Figure 2:
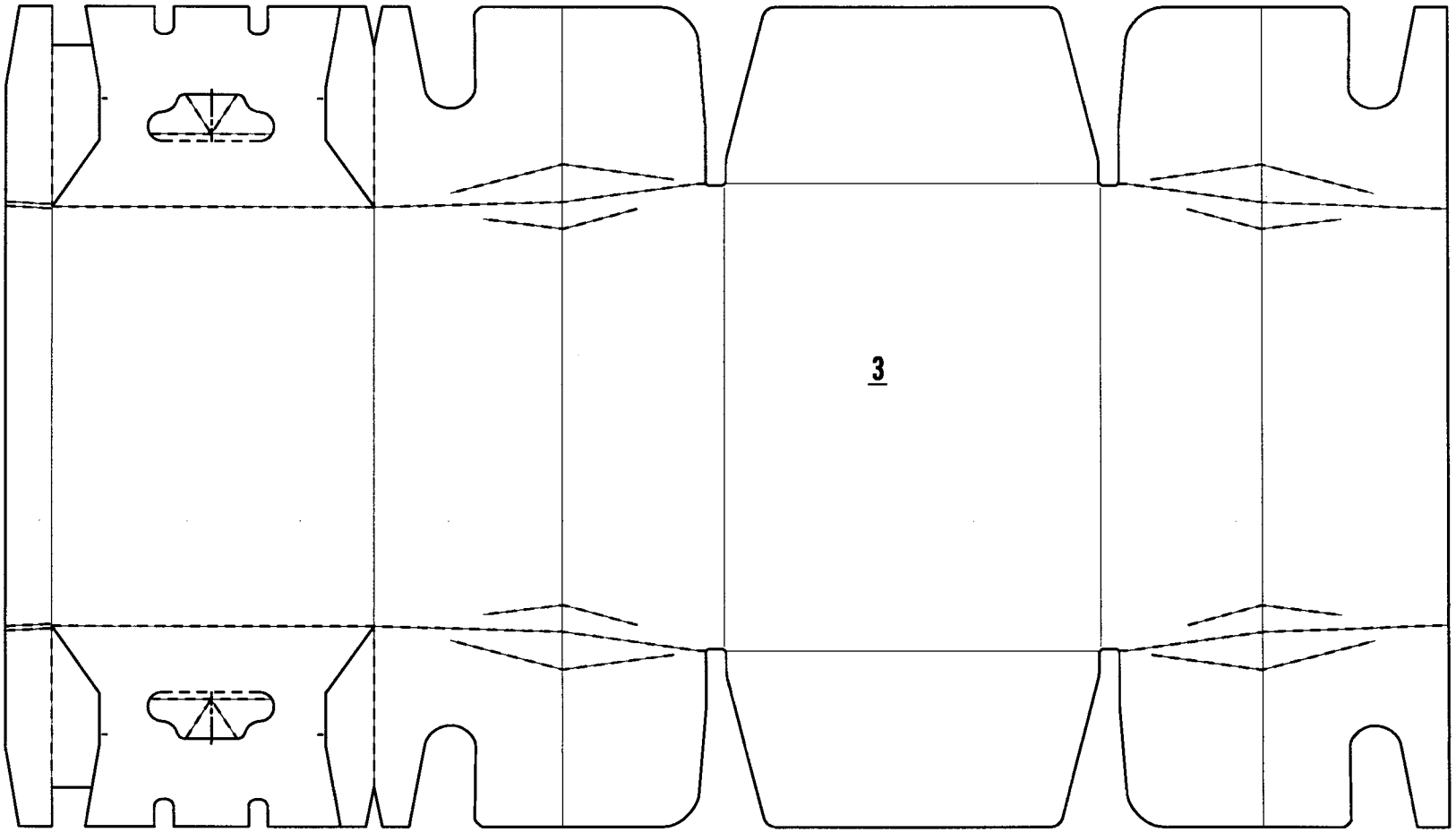
FIGS. 2-8 illustrate various steps in a method of forming a carton from the blank of FIG. 1.
Figure 3:
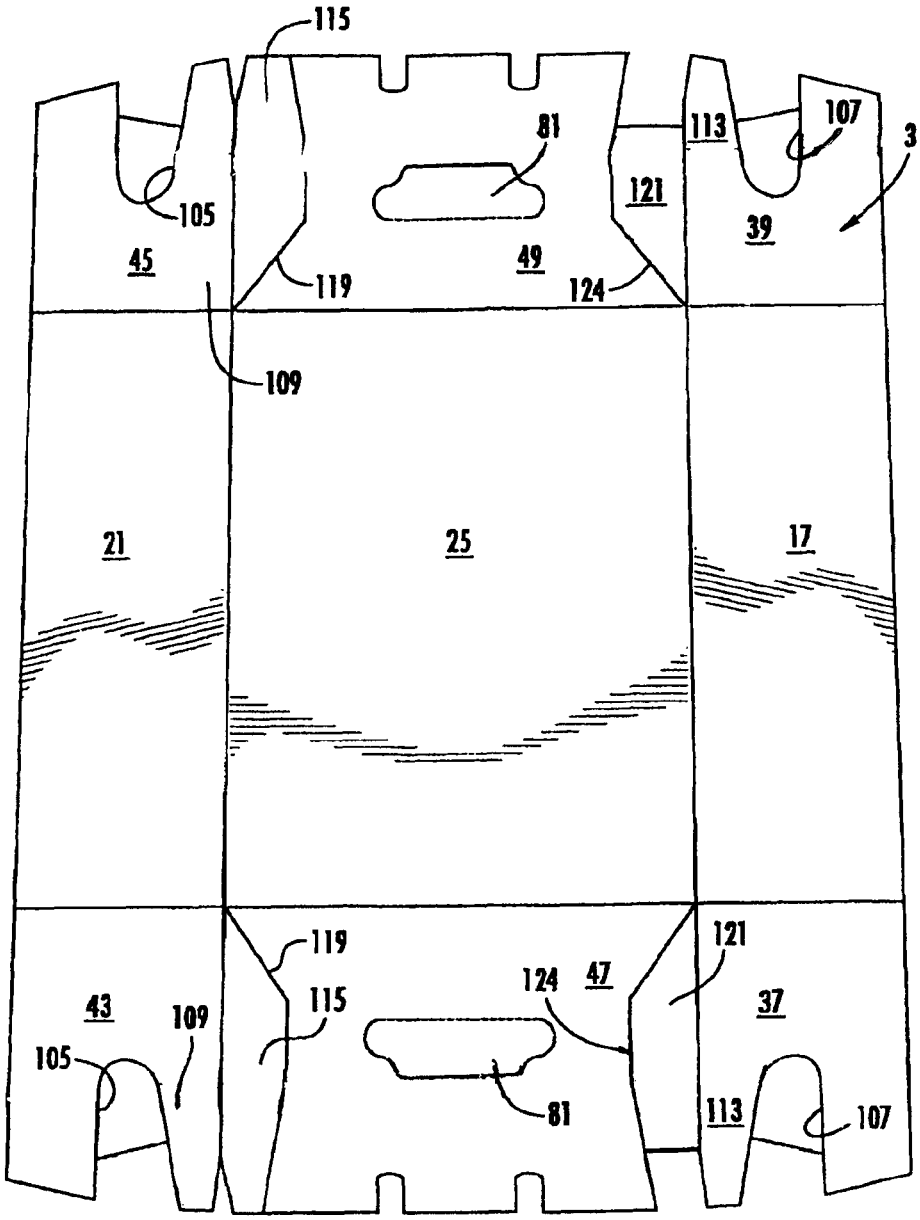

FIG. 1 is a plan view of the exterior side 1 of a blank, generally indicated at 3, used to form a carton 5 (FIG. 9) according to one exemplary embodiment of the disclosure. The carton 5 can be used to house a plurality of articles such as containers C (FIG. 3). In the illustrated embodiment, the containers C are bottles, but the containers could be other beverage containers (e.g., cans, etc.) without departing from the disclosure. In the illustrated embodiment, the carton 5 is sized to house twenty containers C in a single layer in a 4×5 arrangement, but it is understood that the carton 5 may be sized and shaped to hold containers of a different or same quantity in more than one layer and/or in different row/column arrangements (e.g., 1×6, 2×6, 3×6, 4×6, 3×8, 2×6×2, 3×4×2, 2×9, 3×4, etc.).

The carton 5 has first and second ends 7, 9 that have a reinforced handle 10 at each respective end of the carton. In the illustrated embodiment, the carton 5 can have product protection features 111 at least somewhat similar to the product protection features shown and described in the above-noted incorporated-by-reference patent applications. Additionally, the carton 5 could be without product protection features, or with a differing number of product protection features, without departing from the disclosure.

Turning back to FIG. 1, the blank 3 has a longitudinal axis L1 and a lateral axis L2. A bottom panel 15 is foldably connected to a first side panel 21 at a lateral fold line 23. A second side panel 17 is foldably connected to the bottom panel 15 at a lateral fold line 19. A top panel 25 is foldably connected to the first side panel 21 at a lateral fold line 27, and foldably connected to an attachment flap 29 at a lateral fold line 31.

The bottom panel 15 is foldably connected to a first bottom end flap 33 and a second bottom end flap 35. The first side panel 21 is foldably connected to a first side end flap 43 and a second side end flap 45. The second side panel 17 is foldably connected to a first side end flap 37 and a second side end flap 39. The top panel 25 is foldably connected to a first top end flap 47 and a second top end flap 49. The attachment flap 29 is foldably connected to a first attachment end flap 53 and a second attachment end flap 55.

When the carton 5 is erected, the end flaps 33, 37, 43, 47, 53 close the first end 7 of the carton, and the end flaps 35, 39, 45, 49, 55 close the second end 9 of the carton. In accordance with an alternative embodiment of the present disclosure, different flap arrangements can be used for closing the ends 7, 9 of the carton 5.

The end flaps 33, 37, 43, 47, 53 extend along a first marginal area of the blank 3, and are foldably connected at a first longitudinal fold line 61 that extends along the length of the blank. The end flaps 35, 39, 45, 49, 55 extend along a second marginal area of the blank 3, and are foldably connected at a second longitudinal fold line 63 that also extends along the length of the blank. The longitudinal fold lines 61, 63 may be, for example, substantially straight, or offset at one or more locations to account for blank thickness or for other factors.

The blank 3 has a lateral fold line 65 extending through side end flap 37, second side panel 17, and side end flap 39 so that each of these flaps and panels may be folded along the fold line 65 to have an upper portion that tapers inward relative to a lower portion. A lateral fold line 67 extends through the side end flap 43, first side panel 21, and side end flap 45 so that each of these flaps and panels may be folded along the fold line 67 to have an upper portion that tapers inward relative to a lower portion. The blank 3 includes four diamond corners 71 that comprise a first fold line 73 in a respective end flap 37, 39, 43, 45 and a second fold line 73 in a respective side panel 17, 21. The fold lines 73, 75 of the diamond corners 71 are shaped, arranged and positioned to create a corner of the carton 5 that is in a tight fit with the container C adjacent the corner. In one embodiment, the fold lines 65, 67 allow the side panels 17, 21 and ends 7, 9 of the carton 5 to angle inward toward the interior of the carton 5. The diamond corners 71 could be otherwise shaped, arranged, and/or configured without departing from the disclosure.

In one embodiment, the top panel 25 of the blank 3 can have a width and a length less than a respective width and length of the bottom panel 15. In the illustrated embodiment, the narrower width of the top panel 25 than the bottom panel 15 causes the side panels 17, 21 to taper so that the bottom of the side panels are spaced further apart than the top of the side panels. The tapered side panels 17, 21 allow the carton 5 to contact the containers C at both the bottom and top of the containers. The shorter length of the top panel 25 as compared to the bottom panel 15 causes both ends 7, 9 of the carton 5 to be shaped to contact both the top and bottom of the containers C housed in the carton to restrain the movement of the containers in the carton. The bottom panel 15 and/or top panel 25 can be otherwise shaped, arranged, and/or configured without departing from the disclosure. For example, the bottom panel 15 and top panel 25 could have the same width, the same length, or both the same width and length without departing from the disclosure.

The blank 3 comprises features that form the reinforced handle 10 of the carton 5. In one embodiment the features include a handle flap 81 foldably connected to a respective top end flap 47, 49 at a longitudinal fold line 83. In one embodiment, the handle flap 81 is formed by a cut 85 extending from respective ends of the fold line 83. The cut 85 has a longitudinal portion 87 that is generally parallel to the fold line 83 and spaced apart therefrom, a concave portion 89 at a respective end of each longitudinal portion 87, and a convex portion 91 extending between a respective concave portion 89 and a respective end of the longitudinal fold line 89. In one embodiment, the handle flap 81 has a longitudinal fold line 93 extending across the flap and spaced apart from the longitudinal fold line 83 and a v-shaped fold line 95 extending from the longitudinal fold line 93 to the longitudinal portion 87 of the cut 85. The handle flap 81 could be otherwise shaped, arranged, and/or configured without departing from the disclosure.

The handle features of the blank 3 further comprise a handle feature 105 in a respective end flap 43, 45 attached to a first main panel 74, 76 and the first side panel 21. The handle features of the blank 3 further comprise a handle feature 107 in a respective end flap 37, 39 attached to a second main panel 77, 79 and the second side panel 17. The handle features comprise a first reinforcement portion 109 of the end flap 43, 45 above or adjacent the handle feature 105 and a second reinforcement portion 113 of the end flap 37, 39 above or adjacent the handle feature 107. The handle features comprise a first handle reinforcement flap 115 foldably connected to a respective reinforcement portion 109 of the end flaps 43, 45 at an extension 27*a* of the fold line 27. The extension of the fold line 27*a* terminates at a v-shaped notch 117 that is between respective free edges of the first handle reinforcement flap 115 and the first reinforcement portion 109. Further, in one embodiment, the free edges of the first handle reinforcement flap 115 and the first reinforcement portion 109 extend from a respective longitudinal fold line by a distance D1. The reinforcement flaps 115 are separated from an adjacent end flap 47, 49 by a cut 119 that extends from the intersection of the lateral fold line 27 with the longitudinal fold lines 61, 63 to a respective free edge of the blank 3.

In the illustrated embodiment, the handle features of the blank further comprise a second handle reinforcement flap 121 foldably connected to a respective base portion 54, 56 of attachment end flaps 53, 55 of the attachment flap 29 at an extension 31*a* of the lateral fold line 31. In one embodiment, the second handle reinforcement flap 121 is sized so that a free edge of the second handle reinforcement flap 121 is spaced from the lateral fold line 61 by a distance D2. In the illustrated embodiment, the distance D2 is less than the distance D1 such that a notch 123 is created in the blank 3 that is between a respective end flap 53, 55 and a respective end flap 47, 49. The handle reinforcement flaps 121 are separated from an adjacent top end flaps 47, 49 of the blank 3 by a cut 124. In the illustrated embodiment, the top end flaps 47, 49 have notches 125 that are shaped, arranged, and positioned to accommodate the product/article protection features 111 that can be an emboss/deboss area, a bumper, any other product protection feature disclosed in the above-noted incorporated-by-reference provisional patent applications, or any other product protection feature.

As shown in FIGS. 2-10, one exemplary method of forming the carton 5 from the blank is shown. The attachment flap 29 is adhesively attached to a marginal portion of the second side panel 17 and the attachment end flaps 53, 55 are adhesively attached to the reinforcement portion 113 of a respective end flap 37, 39. The method comprises forming the blank 3 into a generally open-ended sleeve 151 (FIG. 4) and loading the sleeve with containers C. Alternatively, the open-ended sleeve 151 can be formed about the containers C. In one embodiment, one end 7, 9 of the sleeve 151 can be closed prior to inserting the containers into the sleeve. In the illustrated embodiment, the closing of the end 7 is shown and described, but the opposite end 9 (FIG. 7) of the carton 5 is closed in a similar manner. In the illustrated embodiment, the reinforced handle 7 in each end 5, 7 is formed upon folding the end flaps closing a respective end of the carton 5.

Figure 4:
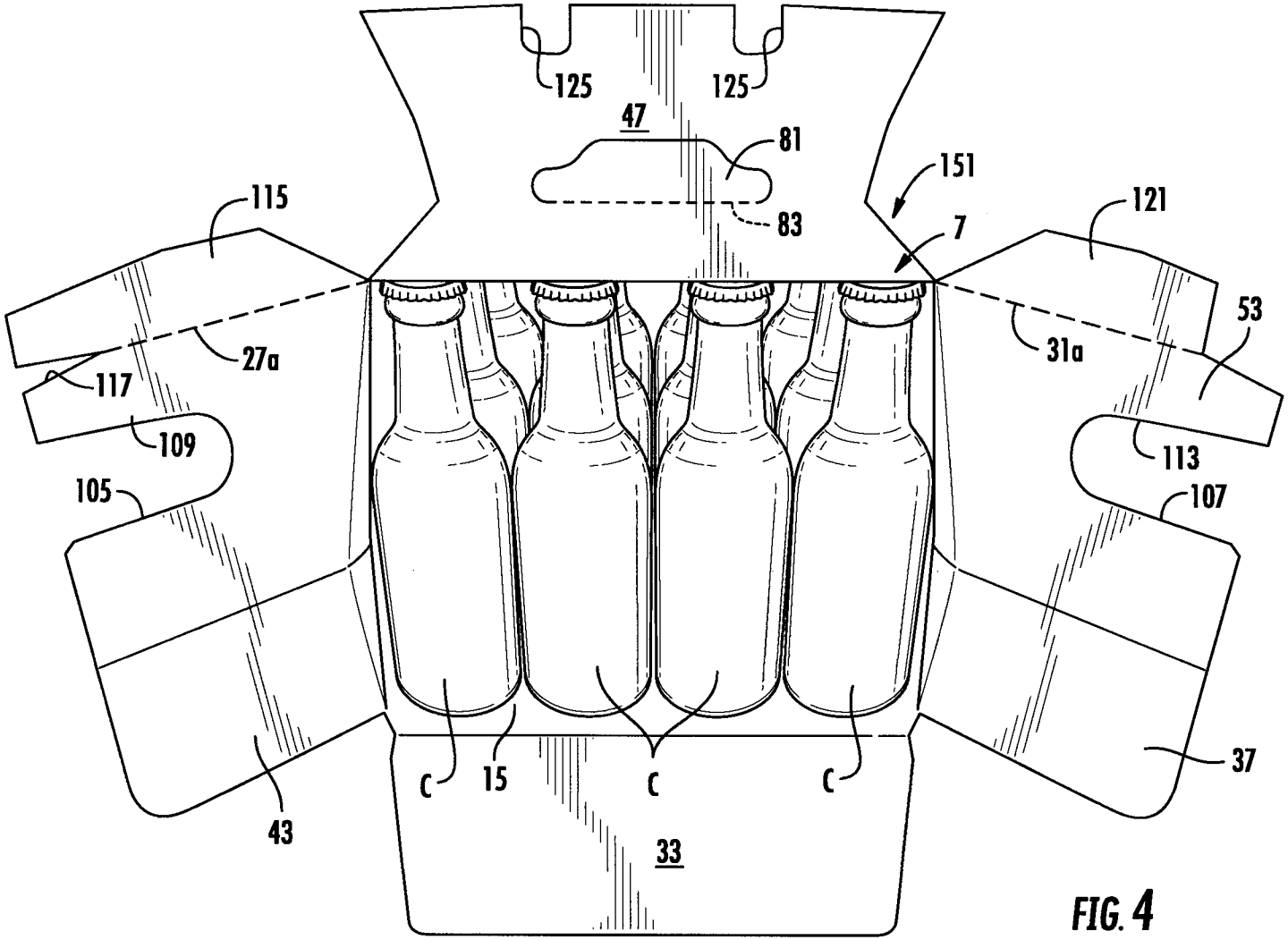
Figure 5:
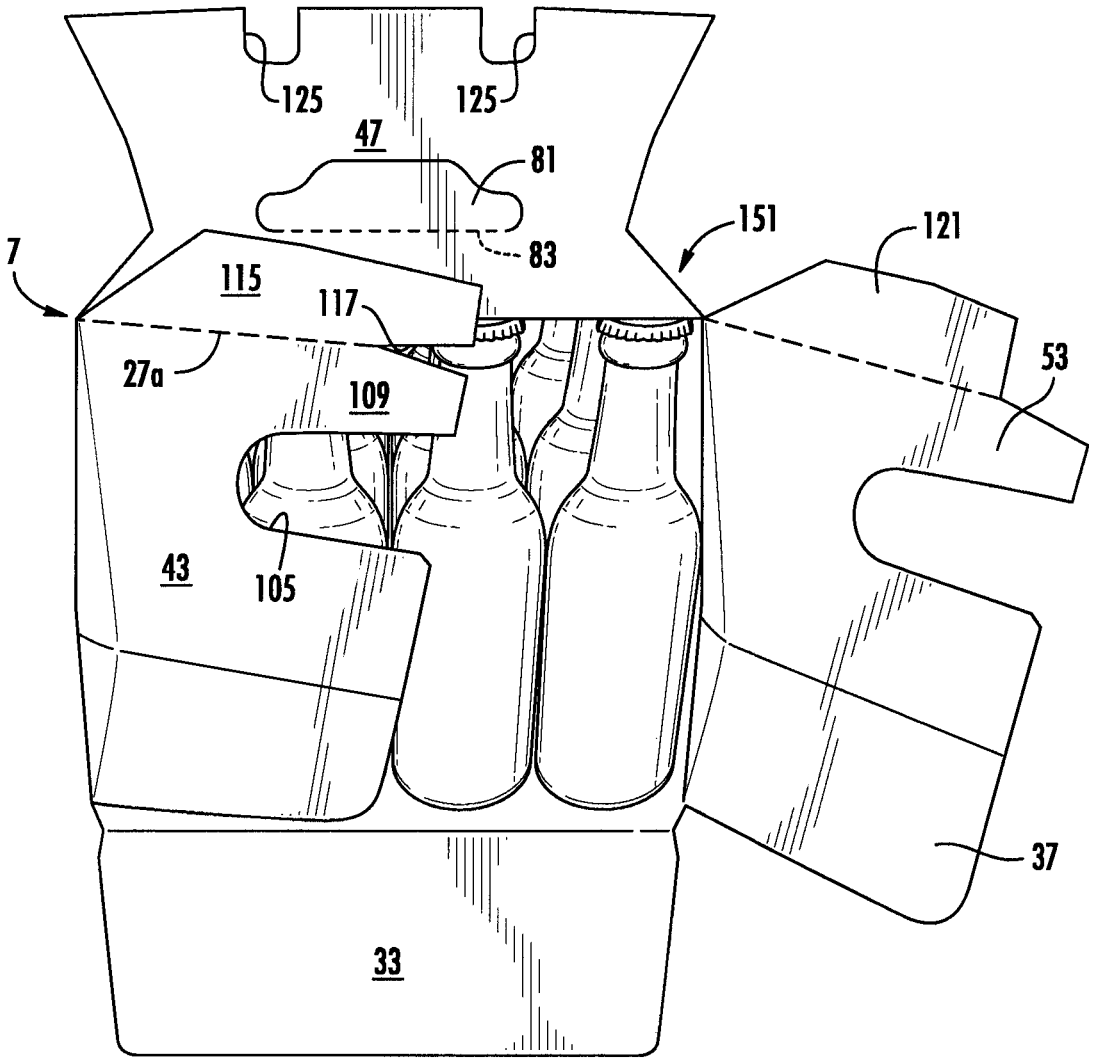
Figure 6:
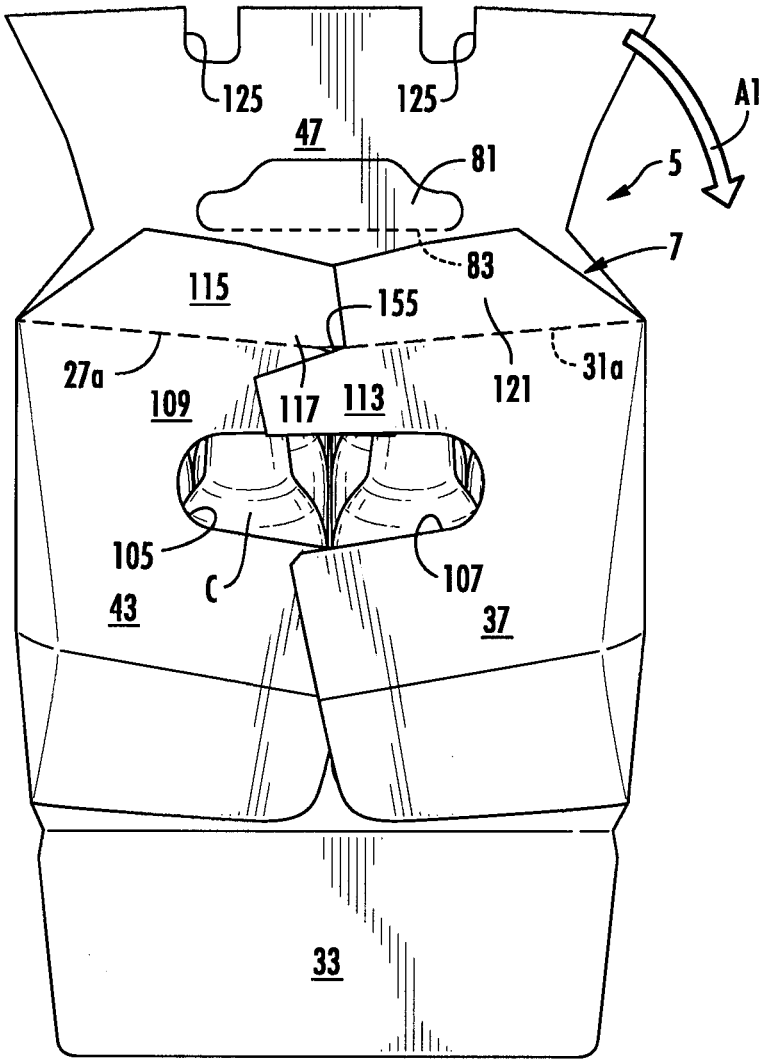
Figure 7:
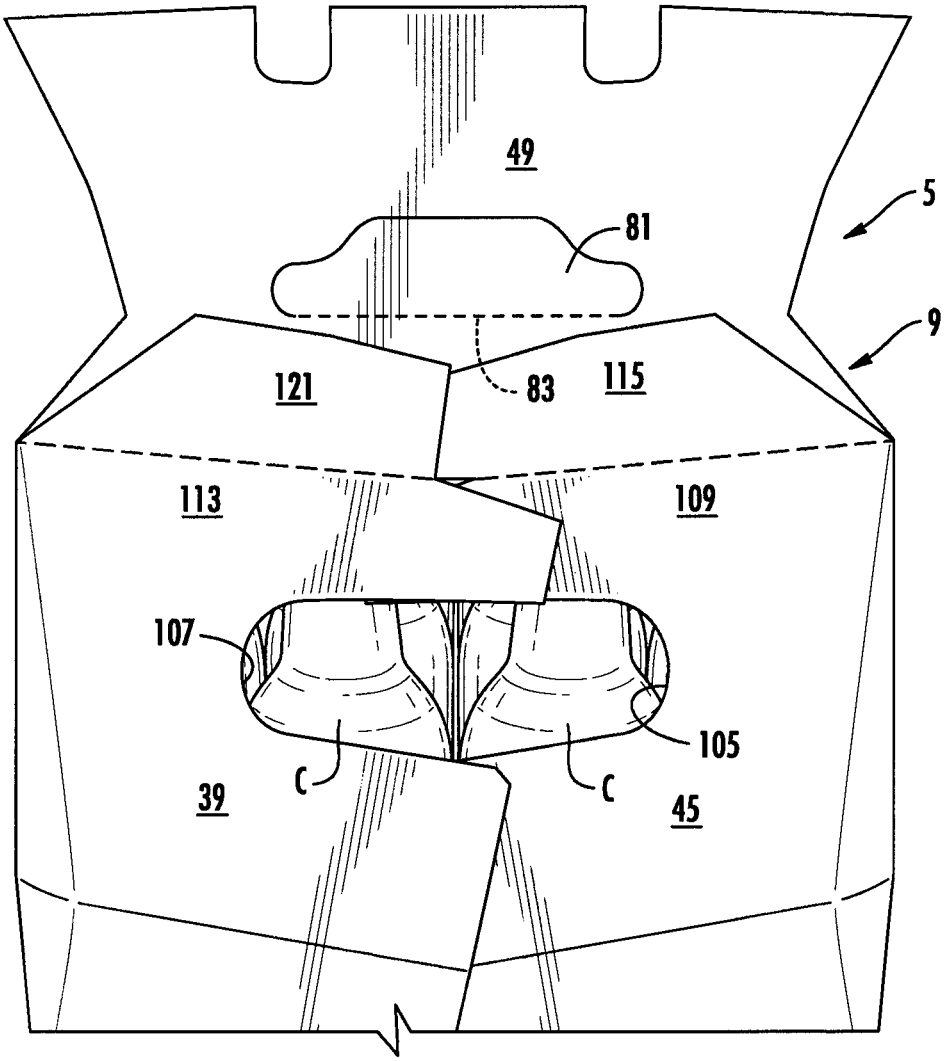

As shown in FIGS. 4-6, after the containers C are loaded, the end flaps 33, 37, 43, 47 can be at least partially overlapped to close the end 7 of the carton 5 and form the reinforced handle 10. As shown in FIG. 5, the end flap 43 is first folded about the fold line 61 to partially close the end 7 of the carton 5. As shown in FIG. 6, the end flap 37, with attached end flap 53 of adhesive panel 29, is folded about fold line 61 to partially overlap the end flap 43. The reinforcement portion 113 of the end flap 37 partially overlaps the reinforcement portion 109 of the end flap 43. Also, the reinforcement flap 21 partially overlaps the reinforcement flap 115. In the illustrated embodiment, the top edge 155 of the reinforcement portion 113 of the end flap 37 is adjacent the v-shaped notch 117 between reinforcement flap 115 and the reinforcement portion 109 of the end flap 43. From the position of FIG. 6, the top end flap 47 is downwardly folded in the direction of arrow Al with the reinforcement flaps 115, 121 being downwardly folded by contact with the top end flap 47. The reinforcement flap 121 is downwardly folded to be in face-to-face contact with the reinforcement portion 113 of the end flap 37. The reinforcement flap 115 is downwardly folded and is in face-to-face contact with a portion of the reinforcement flap 121, a portion of the reinforcement portion 113 of the end flap 37, and a portion of the reinforcement portion 109 of the end flap 43.

Figure 11:
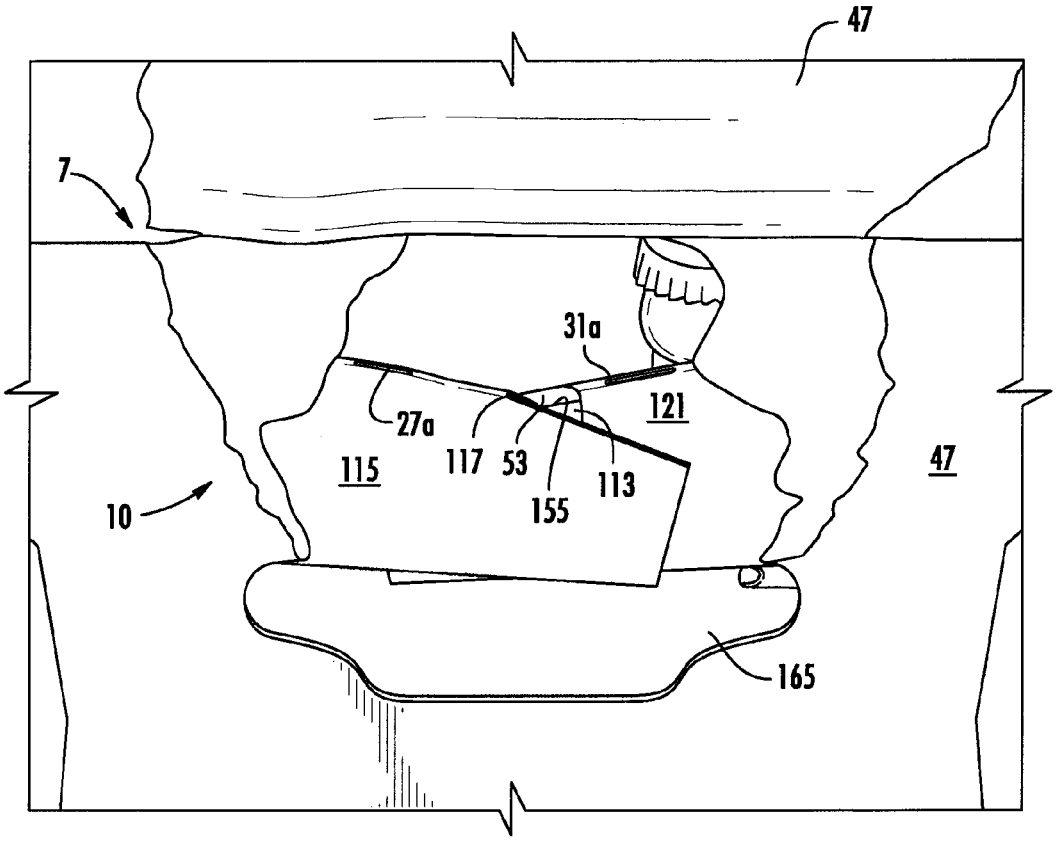
FIG. 11 is a cutaway view showing reinforcement features of a handle of an assembled carton.
Figure 12:
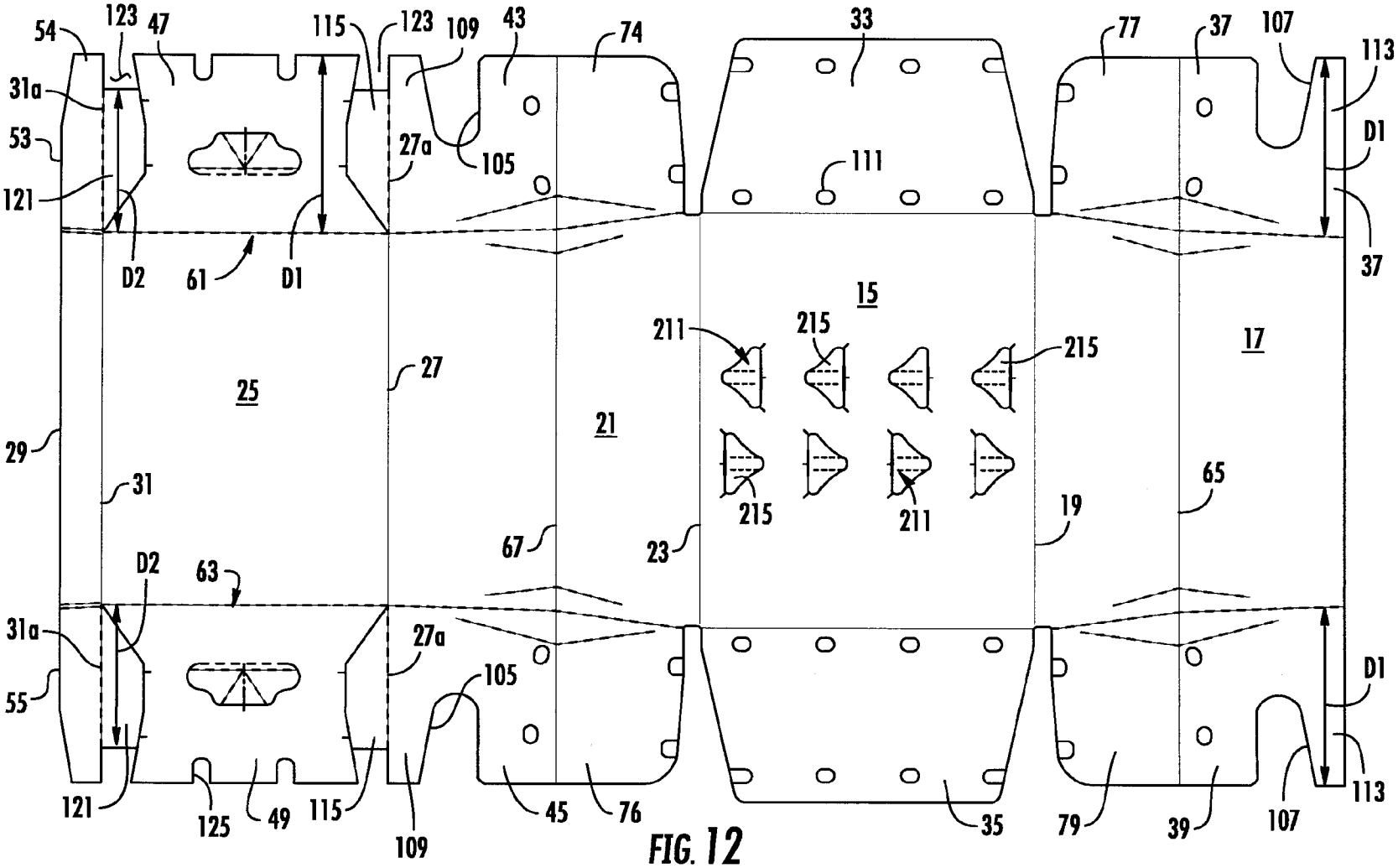
FIG. 12 is a plan view of a blank of a carton, according to a second embodiment.

FIG. 11 shows a cut-away portion of the reinforced handle 10 showing the positioning of the reinforcement flaps 115, 121 in the downwardly folded position. When the reinforcement flaps 115, 121 are downwardly folded, the top edge 155 of the reinforcement portion 113, a portion of the end flap 53, and a portion of the downwardly folded reinforcement flap 121 are positioned in the v-shaped notch 117 between the reinforcement flap 115 and the reinforcement portion 109. The features of the reinforced handle 10 could be otherwise shaped, arranged, configured, and/or positioned without departing from the disclosure.

Figure 8:
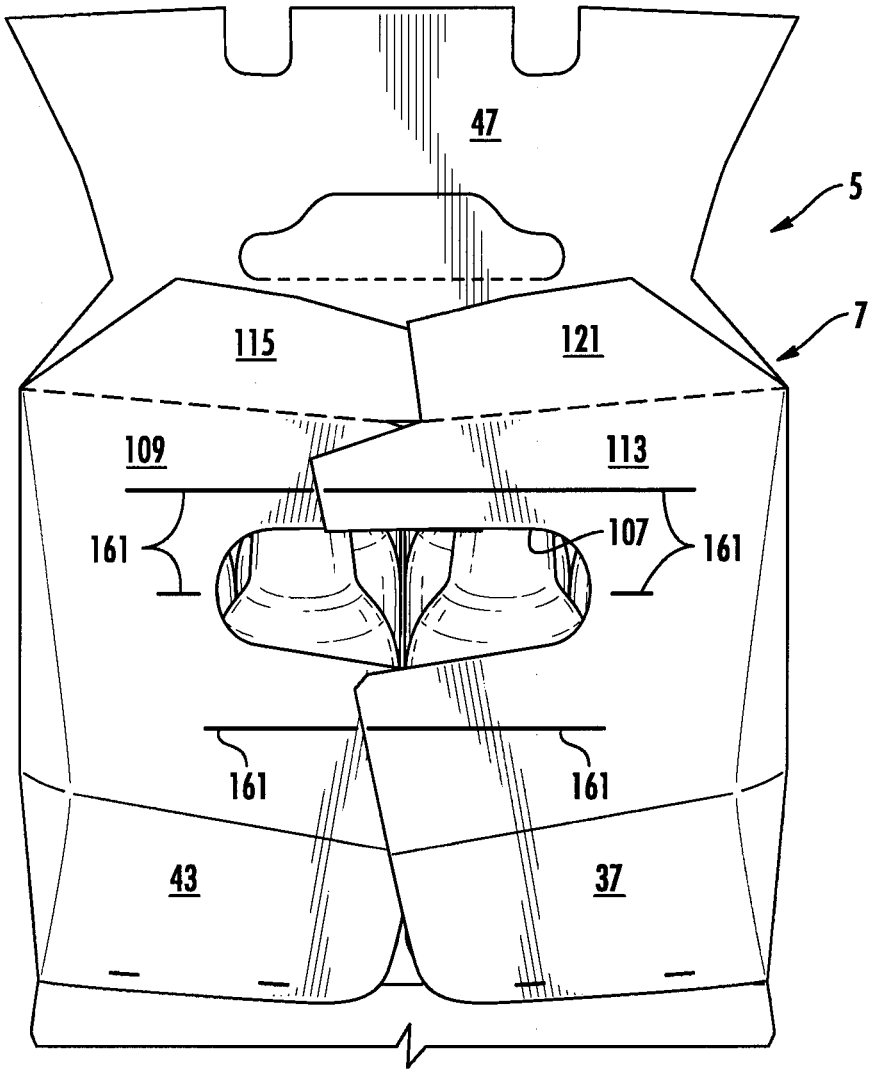

FIG. 8 shows an alternative embodiment of the present disclosure including glue 161 applied to the end flaps 37, 43 including the reinforcement portions 109, 113. Glue 161 can be used to secure the reinforcement flaps 115, 121 in the downwardly folded position, or glue or other adhesive could be omitted without departing from the disclosure.

Figure 9:
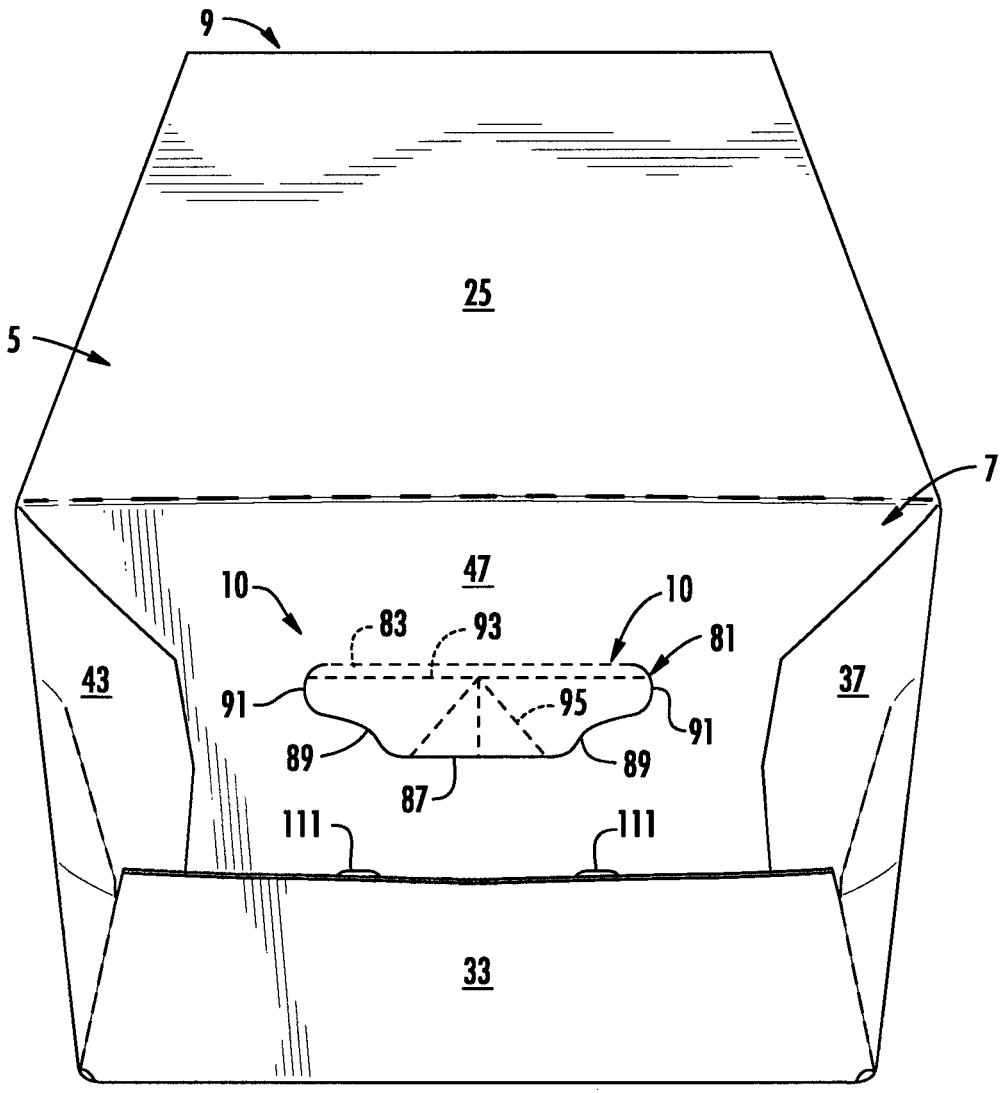
FIG. 9 is a perspective view of an assembled carton.
Figure 10:
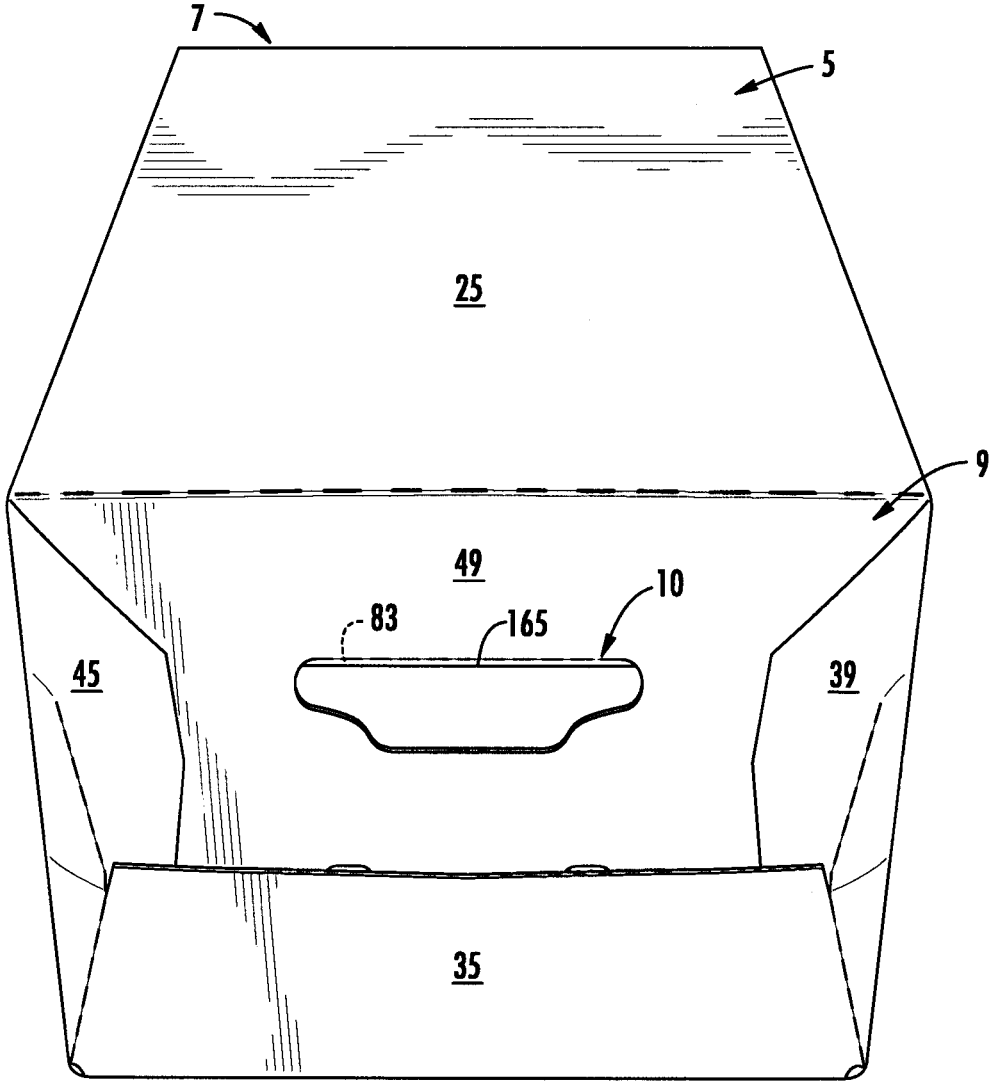
FIG. 10 is an additional perspective view of an assembled carton.

As shown in FIGS. 9 and 10, the handle 10 can be activated by inwardly folding the handle flap 81 about fold line 83 to create a handle opening 165 in a respective end 7, 9 of the carton 5. The handle flap 81 is shaped by the cut line 81 of the blank so that the inwardly folded handle flap 81 does not interfere with or contact the bottles C that are adjacent a respective end 7, 9 of the carton 5. The handle flap 81 could be otherwise shaped, arranged, and/or configured without departing from the disclosure. The reinforcement flaps 115, 121, reinforcement portions 109, 113, end flaps 53, 55, and the attachment panel 29 cooperate to form a reinforcement band of the carton 5 that extends around the perimeter of the top of the carton. In the ends 7, 9 the reinforcement band forms the reinforced handles 10 with reinforcement band being above the handle openings 165. In this way, the carton 5 is reinforced and deformation or tearing at the handles 10 is prevented.

As described above, the handle 10 is reinforced by several layers or plies of material. For example, the handle 10 may be reinforced by a plurality of layers of paperboard directly above the handle opening at least partially formed by the cooperating notches 105 and 107, top end flap 47, reinforcement flap 121, reinforcement flap 115, reinforcement portion 109, reinforcement portion 113, attachment end flap 53, and/or handle flap 81. For example, according to one embodiment, the reinforcement flap 115, the first reinforcement portion 109, and the second reinforcement portion 113 form three plies of material located above the handle 10 to reinforce the handle 10. According to another embodiment, the attachment end flap 53, the second reinforcement portion 113, the first reinforcement portion 109, the first reinforcement flap 115, and the second reinforcement flap 121 comprise five plies of material located above the handle 10 to reinforce the handle 10.

FIGS. 12-16 illustrate a blank 203 for forming a carton 205 having a reinforced handle 210 according to a second embodiment of the disclosure. The blank 203 has similar features as the blank 3 of the first embodiment and like or similar reference number are used to indicated like or similar features between the first and second embodiments. In the second embodiment, each of the reinforcement flaps 115., 121 are approximately the same length so that the reinforcement flaps do not overlap in the carton 205 formed from the blank 203. Also, the bottom end flaps 33, 35 have been extended to have a longer length so that the free edge of the bottom end flaps are farther from a respective longitudinal fold line 61, 63 in the second embodiment of the disclosure.

In the embodiment of FIGS. 12-16, both the reinforcement flaps 115, 121 have a length D2 extending from the longitudinal fold line 61, 63 to a respective free edge of the reinforcement flaps. As with the previous embodiment, the handle reinforcement portions 109, 113 of respective end flaps 43, 45 and 37, 39 have a length D1. In the embodiment of FIGS. 12-16, both the reinforcement flaps 115, 121 have a length D2 that is less than the length D1 of the reinforcement portions 109, 113.

In one embodiment, the length D1 is at least approximately 5.2 inches (131 mm) and the length D2 is approximately 4.1 inches (104 mm) or less. In the illustrated embodiment, D2 is approximately 80 percent of D1, but D2 could be more or less than listed or shown herein without departing from the disclosure. The dimensions listed herein and/or shown on the drawings are intended to be illustrative of certain embodiments or features of the disclosure and are not intended to limit the scope of the claims unless otherwise noted herein.

In the embodiment of FIGS. 12-15, the bottom panel 15 includes protection elements 211 in the form of flaps 215 foldably connected to the bottom panel. The protection elements are similar to the protection elements disclosed in U.S. patent application Ser. No. 13/419,740, filed Mar. 14, 2012. The protection elements 211 could be otherwise shaped, arranged, and/or configured without departing from the disclosure, or the protection elements could be omitted without departing from the disclosure.

As shown in FIGS. 13-16 the carton 205 is formed from the blank 203 in a similar manner as set forth above for the first embodiment. As shown in FIG. 13-16, the reinforced handle 210 is formed in a similar manner as the reinforced handle 10 of the previous embodiment. Also, the reinforced handle 210 can be formed in both ends of the carton, but only one end 7 is shown in the Figures and described herein.

Figure 13:
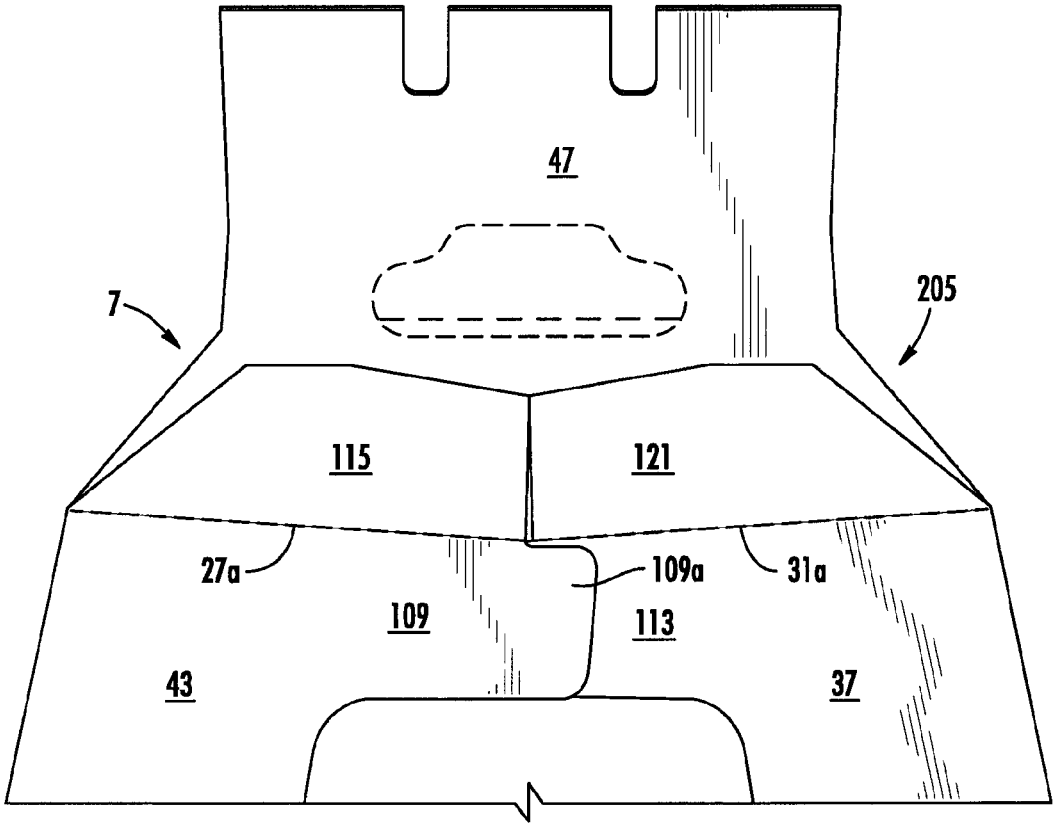
FIG. 13 is a perspective view of alternate reinforcement features of a handle of an assembled carton.
Figure 14:
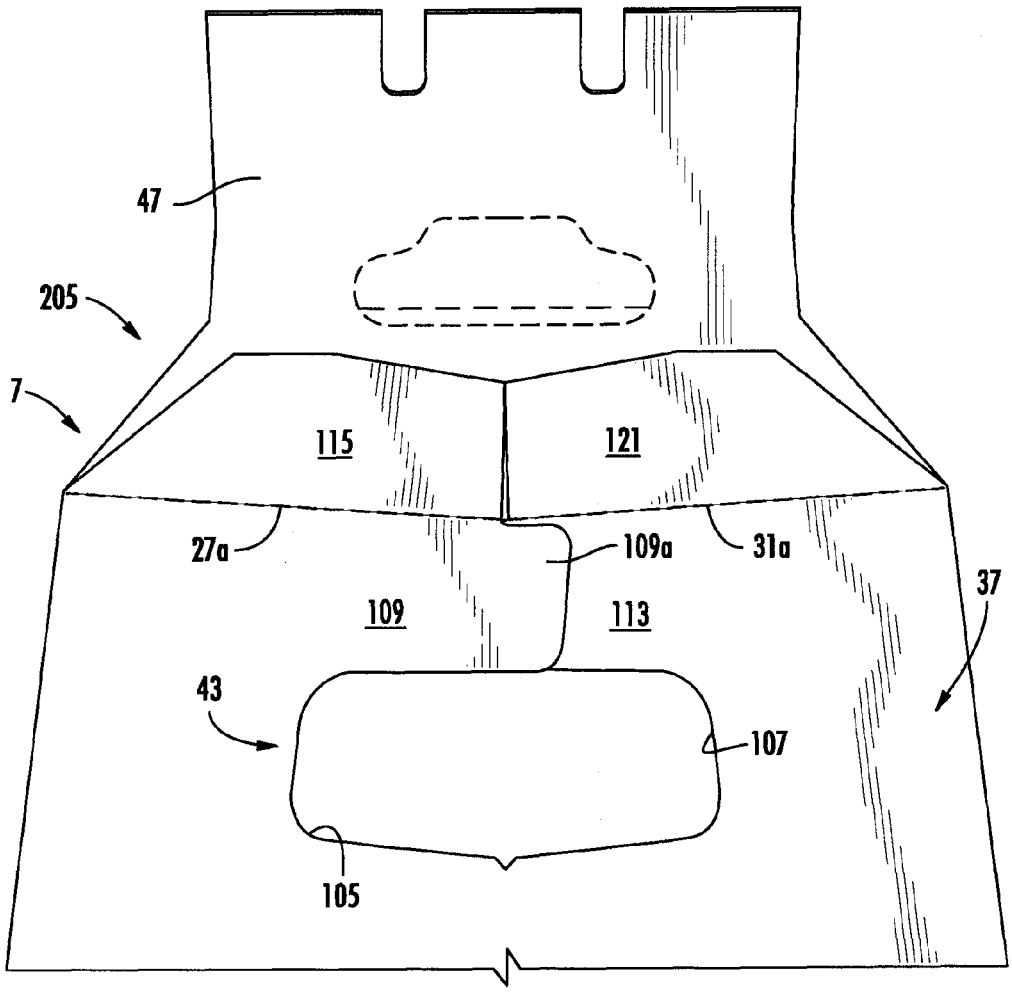
FIG. 14 is an additional perspective view the reinforcement features of a handle of an assembled carton.
Figure 15:
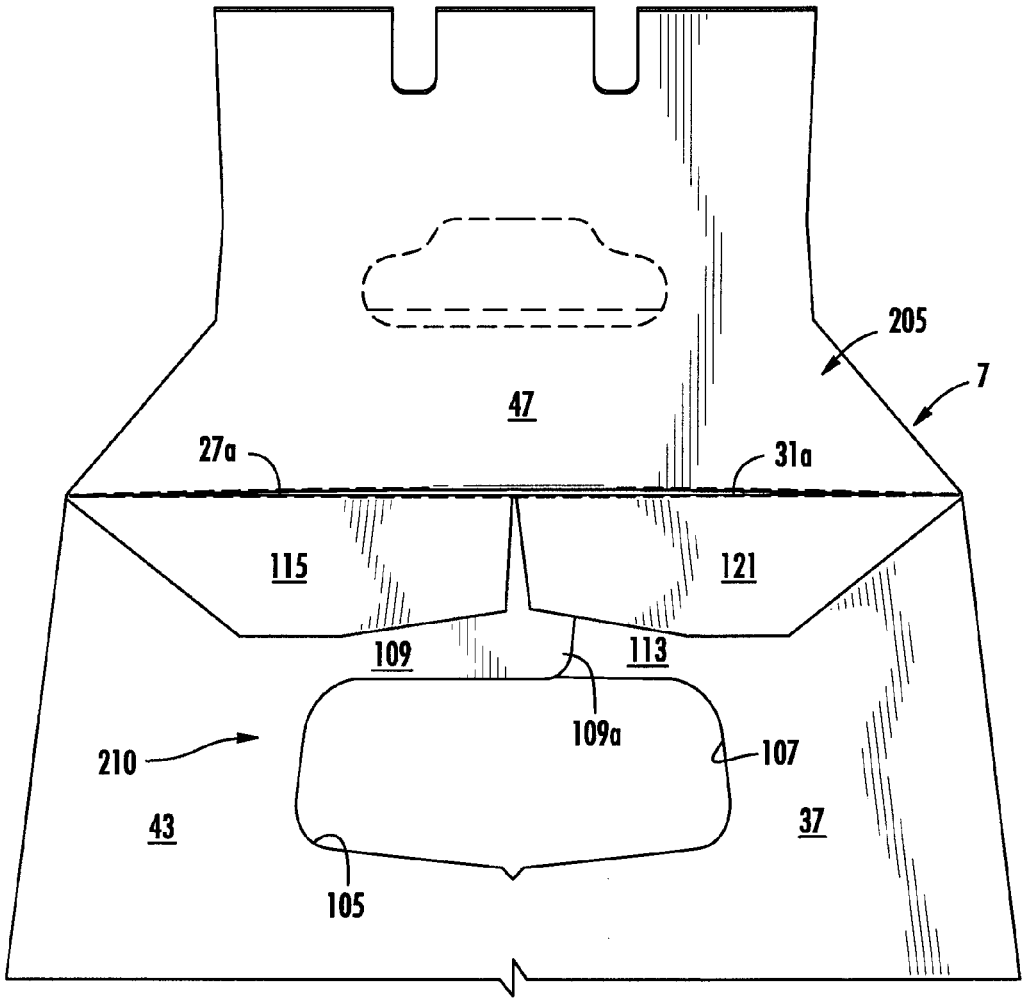
FIG. 15 is an elevation view of alternate reinforcement features of a handle of an assembled carton.
Figure 16:
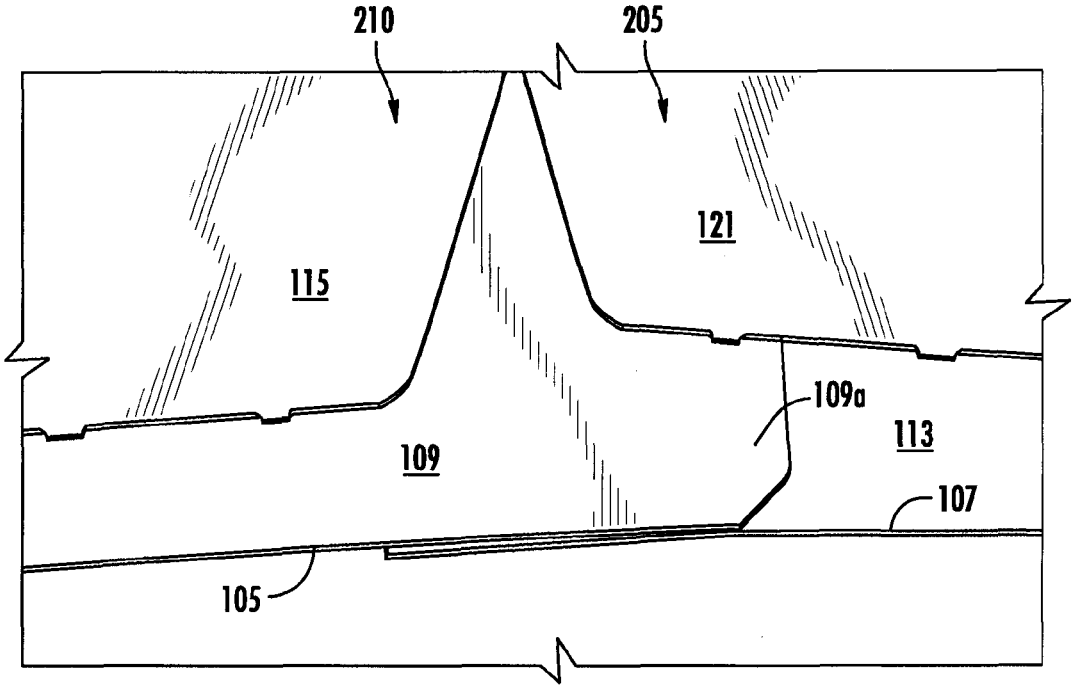
FIG. 16 is an expanded view of alternate reinforcement features of a handle of an assembled carton.

The blank 203 is formed into the carton 210 as shown in FIG. 13 with a partially open end 7 with the reinforcement flaps 115, 121 being in generally face-to-face contact with the upwardly folded top end flap 47. As shown in FIGS. 13-16, the side end flap 43 partially overlaps the side end flap 37 so that the reinforcement portion 109 overlaps the reinforcement portion 113. A distal portion 109*a* (FIG. 13) of the reinforcement portion 109 is located below the reinforcement flap 121 of the side end flap 37. As the end 7 is closed by the downward folding of the top end flap 47, the reinforcement flaps 115, 121 are downwardly folded at respective fold lines 27*a*, 31*a* (FIGS. 14, 15). As shown in FIG. 16, the reinforcement flap 115 is further downwardly folded to be in face-to-face contact with the reinforcement portion 109 and the reinforcement flap 121 is further downwardly folded to be in face-to-face contact with the reinforcement portion 113 and the distal portion 109*a* of the reinforcement portion 109. In this way, the handle 210 is reinforced by a plurality of layers of paperboard (e.g., three, four, five, or six plies of material) directly above the handle opening at least partially formed by the cooperating notches 105, 107 (top end flap 47, reinforcement flap 121, distal portion 109*a* of the reinforcement portion 109, reinforcement portion 113, and handle flap 81). As with the previous embodiment, glue or other adhesive can be placed between the reinforcement portions 109, 113 and the reinforcement flaps 115, 121, or at other locations of the flap arrangement.

As with the previous embodiment, the end 7 can be closed by other flap positioning sequences and the handle 210 can be formed by other flap positioning sequences without departing from the disclosure. The embodiment of FIGS. 12-16 allows the reinforcement flap (e.g., 121) attached to an opposite side end flap (e.g., 37) to overlap and/or be secured to the reinforcement portion (e.g., 109) of an opposite side end flap (e.g., 43) so that the handle 210 is strengthened and reinforced. The handle 210 could be reinforced by alternate positioning of the reinforcement flaps 115, 121 and reinforcement portions 109, 113 without departing from the disclosure. For example, the reinforcement portion 113 could overlap the reinforcement portion 109 and the handle reinforcement flap 115 foldably connected to the side end flap 43 could be positioned to overlap a distal portion of the reinforcement portion 113 of the side end flap 37.

The cartons 5 of any of the illustrated or non-illustrated embodiments of the disclosure could have other features (e.g., dispenser features, handle features, reinforcement features, etc.) without departing from the disclosure. Also, the cartons 5 could be otherwise shaped, arranged, or configured and the cartons could be configured to hold articles other than beverage containers C without departing from the disclosure.

In general, the blank may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing a plurality of articles, the carton comprising:

a plurality of panels that extends at least partially around an interior of the carton, the plurality of panels comprises a top panel, a bottom panel, a first side panel, and a second side panel;

at least three first end flaps respectively foldably connected to respective panels of the plurality of panels, the at least three first end flaps cooperate to close a first end of the carton, the at least three first end flaps comprise a first side end flap foldably connected to the first side panel, a second side end flap foldably connected to the second side panel, and a top end flap foldably connected to the top panel; and a handle in the first end of the carton for grasping and carrying the carton, wherein:

the first side end flap comprises a first main panel, a first handle feature for forming the handle, a first reinforcement portion above the first handle feature, and a first reinforcement flap foldably connected to the first reinforcement portion, the second side end flap comprises a second main panel, a second handle feature for forming the handle, a second reinforcement portion above the second handle feature, a second reinforcement flap foldably connected to the second reinforcement portion, and an interior surface facing the interior of the carton and an exterior surface opposite the interior surface, and the first reinforcement flap and the second reinforcement flap are downwardly folded to at least partially overlap the second reinforcement portion to reinforce the handle, and the first reinforcement flap and the second reinforcement flap are in face-to-face contact with at least a portion of the exterior surface of the second side end flap.

2. The carton of claim 1, wherein the first reinforcement portion at least partially overlaps the second reinforcement portion.

3. The carton of claim 1, wherein the reinforcement flap, the first reinforcement portion, and the second reinforcement portion form three plies of material located above the handle to reinforce the handle.

4. The carton of claim 1, wherein the carton comprises an attachment flap and an attachment end flap foldably connected to the attachment flap, the attachment end flap comprises a base portion and the second reinforcement flap, the second reinforcement flap being foldably connected to the base portion.

5. The carton of claim 4, wherein the base portion is adhesively connected to the second reinforcement portion.

6. The carton of claim 5, wherein the attachment flap is adhesively connected to the second side panel, the second side panel overlapping the attachment flap and the second reinforcement portion overlapping the base portion.

7. The carton of claim 5, wherein the attachment end flap, the second reinforcement portion, the first reinforcement portion, the first reinforcement flap, and the second reinforcement flap comprise five plies of material located above the handle to reinforce the handle.

8. The carton of claim 1, wherein the top end flap comprises a third handle feature, the first handle feature comprises a first handle opening, the second handle feature comprises a second handle opening, and the third handle feature comprises a handle flap foldably connected to the top end flap, the handle flap, the first handle opening, and the second handle opening cooperate to form the handle.

9. The carton of claim 8, wherein the handle flap is upwardly folded and in face-to-face contact with an interior surface of each the first side end flap and the second side end flap to reinforce the handle.

10. The carton of claim 1, wherein the top end flap is in face-to-face contact with the first reinforcement flap and the second reinforcement flap.

11. The carton of claim 1, wherein the top end flap is foldably connected to the top panel at a fold line, a peripheral free edge of the first reinforcement flap is spaced apart from the fold line by a first distance, a peripheral free edge of the second reinforcement flap is spaced apart from the fold line by a second distance.

12. The carton of claim 11, wherein the first distance is substantially equal to the second distance.

13. The carton of claim 12, wherein the peripheral edge of the top end flap is spaced apart from the fold line by a third distance, the third distance being greater than the second distance.

14. The carton of claim 11, wherein the first distance is substantially greater than the second distance.

15. A carton for containing a plurality of articles, the carton comprising:

a plurality of panels that extends at least partially around an interior of the carton, the plurality of panels comprises a top panel, a bottom panel, a first side panel, and a second side panel;

at least three first end flaps respectively foldably connected to respective panels of the plurality of panels, the at least three first end flaps cooperate to close a first end of the carton, the at least three first end flaps comprise a first side end flap foldably connected to the first side panel, a second side end flap foldably connected to the second side panel, and a top end flap foldably connected to the top panel; and a handle in the first end of the carton for grasping and carrying the carton, wherein:

the first side end flap comprises a first main panel, a first handle feature for forming the handle, a first reinforcement portion above the first handle feature, and a first reinforcement flap foldably connected to the first reinforcement portion, the second side end flap comprises a second main panel, a second handle feature for forming the handle, a second reinforcement portion above the second handle feature, and a second reinforcement flap foldably connected to the second reinforcement portion, the first reinforcement flap and the second reinforcement flap are downwardly folded to at least partially overlap the second reinforcement portion to reinforce the handle, and the first side end flap comprises a notch between the first reinforcement flap and the first reinforcement portion, the notch being at a free edge of the first side end flap.

16. The carton of claim 15, wherein the at least a portion of the second reinforcement portion is received in the notch.

17. The carton of claim 16, wherein at least a portion of the second reinforcement flap is received in the notch.

18. A blank for forming a carton, the blank comprising:

a plurality of panels comprising a top panel, a bottom panel, a first side panel, and a second side panel;

at least three first end flaps respectively foldably connected to respective panels of the plurality of panels, the at least three first end flaps being configured to cooperate to close a first end of a carton formed of the blank, the at least three first end flaps comprise a first side end flap foldably connected to the first side panel, a second side end flap foldably connected to the second side panel, and a top end flap foldably connected to the top panel; and features for forming a handle in the at least three first end flaps, wherein:

the first side end flap comprises a first main panel, a first handle feature for forming the handle, a first reinforcement portion above the first handle feature, a first reinforcement flap foldably connected to the first reinforcement portion, and a notch between the first reinforcement flap and the first reinforcement portion, the notch being at a free edge of the first side end flap, the second side end flap comprises a second main panel, a second handle feature for forming the handle, a second reinforcement portion above the second handle feature, and a second reinforcement flap foldably connected to the second reinforcement portion, and the first reinforcement flap and the second reinforcement flap are configured to be downwardly folded to at least partially overlap the second reinforcement portion to reinforce the handle when the blank is formed into a carton.

19. The blank of claim 18, further comprising an attachment flap and an attachment end flap foldably connected to the attachment flap, the attachment end flap comprises a base portion and the second reinforcement flap, the second reinforcement flap being foldably connected to the base portion.

20. The blank of claim 18, wherein the notch is configured to receive at least a portion of the second reinforcement portion in a carton assembled from the blank.

21. The blank of claim 18, wherein the top end flap comprises a third handle feature, the first handle feature comprises a first handle opening, the second handle feature comprises a second handle opening, and the third handle feature comprises a handle flap foldably connected to the top end flap, the handle flap, the first handle opening, and the second handle opening are configured to cooperate to form the handle in a carton assembled from the blank.

22. The blank of claim 21, wherein the handle flap is configured to be upwardly folded and placed in face-to-face contact with an interior surface of each the first side end flap and the second side end flap to reinforce the handle in a carton assembled from the blank.

23. The blank of claim 18, wherein the top end flap is foldably connected to the top panel at a fold line, a peripheral free edge of the first reinforcement flap is spaced apart from the fold line by a first distance, a peripheral free edge of the second reinforcement flap is spaced apart from the fold line by a second distance.

24. The blank of claim 23, wherein the first distance is substantially equal to the second distance.

25. The blank of claim 24, wherein the peripheral edge of the top end flap is spaced apart from the fold line by a third distance, the third distance being greater than the second distance.

26. The blank of claim 23, wherein the first distance is substantially greater than the second distance.

27. A method of forming a carton for containing a plurality of articles, the method comprising:

obtaining a blank comprising a plurality of panels, the plurality of panels comprises a top panel, a bottom panel, a first side panel, and a second side panel, the blank further comprising at least three first end flaps respectively foldably connected to respective panels of the plurality of panels, the at least three first end flaps comprise a first side end flap foldably connected to the first side panel, a second side end flap foldably connected to the second side panel, and a top end flap foldably connected to the top panel, wherein, the first side end flap comprises a first main panel, a first handle feature, a first reinforcement portion above the first handle feature, and a first reinforcement flap foldably connected to the first reinforcement portion, and the second side end flap comprises a second main panel, a second handle feature, a second reinforcement portion above the second handle feature, a second reinforcement flap foldably connected to the second reinforcement portion, and an interior surface facing the interior of the carton and an exterior surface opposite the interior surface;

forming at least a portion of an interior of the carton by folding the plurality of panels;

folding the at least three first end flaps to at least partially close a first end of the carton;

at least partially forming the handle from the first handle feature and the second handle feature; and downwardly folding the first reinforcement flap and the second reinforcement flap to position the first reinforcement flap and the second reinforcement flap in face-to-face contact with at least a portion of the exterior surface of the second side end flap and to at least partially overlap the second reinforcement portion to reinforce the handle.

28. The method of claim 27, further comprising positioning the first reinforcement portion to at least partially overlap the second reinforcement portion.

29. The method of claim 27, further comprising positioning the first reinforcement flap, the first reinforcement portion, and the second reinforcement portion to form three plies of material located above the handle to reinforce the handle.

30. The method of claim 27, wherein the blank comprises an attachment flap and an attachment end flap foldably connected to the attachment flap, the attachment end flap comprises a base portion and the second reinforcement flap, the second reinforcement flap being foldably connected to the base portion.

31. The method of claim 30, further comprising adhesively connecting the base portion to the second reinforcement portion.

32. The method of claim 31, further comprising adhesively connecting the attachment flap to the second side panel, the second side panel overlapping the attachment flap and the second reinforcement portion overlapping the base portion.

33. The method of claim 31, further comprising positioning the attachment end flap, the second reinforcement portion, the first reinforcement portion, the first reinforcement flap, and the second reinforcement flap to form five plies of material located above the handle to reinforce the handle.

34. The method of claim 27, wherein the top end flap comprises a third handle feature, the first handle feature comprises a first handle opening, the second handle feature comprises a second handle opening, and the third handle feature comprises a handle flap foldably connected to the top end flap, the handle flap, the first handle opening, and the second handle opening cooperate to form the handle.

35. The method of claim 34, further comprising upwardly folding the handle flap to be in face-to-face contact with an interior surface of each the first side end flap and the second side end flap to reinforce the handle.

36. The method of claim 27, wherein the top end flap is foldably connected to the top panel at a fold line, a peripheral free edge of the first reinforcement flap is spaced apart from the fold line by a first distance, a peripheral free edge of the second reinforcement flap is spaced apart from the fold line by a second distance.

37. The method of claim 36, wherein the first distance is substantially equal to the second distance.

38. The method of claim 37, wherein the peripheral edge of the top end flap is spaced apart from the fold line by a third distance, the third distance being greater than the second distance.

39. The method of claim 3, wherein the first distance is substantially greater than the second distance.

* * * * *